US007344029B2

(12) United States Patent
Sattora et al.

(10) Patent No.: US 7,344,029 B2
(45) Date of Patent: Mar. 18, 2008

(54) SIX-SIDED CORRUGATED ROLLOVER CUSHION

(75) Inventors: Christopher J. Sattora, Cary, NC (US); Eric Allen Stegner, Durham, NC (US); Robert William Stegner, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 212 days.

(21) Appl. No.: 11/220,493

(22) Filed: Sep. 7, 2005

(65) Prior Publication Data

US 2007/0051659 A1 Mar. 8, 2007

(51) Int. Cl.
*B65D 81/02* (2006.01)

(52) U.S. Cl. ..... 206/592; 206/521

(58) Field of Classification Search ..... 206/320, 206/521, 583, 591, 592, 784, 525.1, 586, 206/594; 229/191, 177–179, 918
See application file for complete search history.

(56) References Cited

U.S. PATENT DOCUMENTS

| | | | | | |
|---|---|---|---|---|---|
| 3,211,282 | A * | 10/1965 | Hennessey | 206/590 |
| 3,368,735 | A | 2/1968 | Levi | |
| 3,994,399 | A * | 11/1976 | Numata et al. | 206/594 |
| 5,522,504 | A | 6/1996 | Levi | |
| 5,806,683 | A * | 9/1998 | Gale | 206/592 |
| 6,079,563 | A * | 6/2000 | Katchmazenski | 206/583 |
| 6,675,970 | B1 * | 1/2004 | Nemoto | 206/521 |
| 6,685,026 | B1 | 2/2004 | Hanna | |
| 6,997,323 | B2 * | 2/2006 | Maresh et al. | 206/592 |

FOREIGN PATENT DOCUMENTS

JP 5-213335 8/1993

* cited by examiner

*Primary Examiner*—Luan K Bui
(74) *Attorney, Agent, or Firm*—Gregory M. Doudnikoff; Dillon & Yudell LLP

(57) ABSTRACT

A rollover shipping cushion is presented. The cushion is formed by folding, in a specific manner, a single sheet of die-cut corrugated fiberboard to create the cushion. When properly folded, the cushion includes a central shipping cavity that is surrounded by shock-absorbing tubes on all six sides of the central shipping cavity.

3 Claims, 16 Drawing Sheets

SIX-SIDED CORRUGATED ROLLOVER CUSHION

BACKGROUND OF THE INVENTION

1. Technical Field

The present invention relates in general to the field of shipment packaging, and in particular to corrugated fiberboard packing. Still more particularly, the present invention relates to a single piece of corrugated fiberboard that, when folded, creates a six-sided cushion for fragile shipments.

2. Description of the Related Art

Light and fragile products, including electronic equipment, are typically shipped from a manufacturer to a customer or distributor via a common carrier. The products must therefore be packaged to prevent being damaged in transit from physical shock (jarring) caused by being dropped, jostled, etc. The force of such physical shock can be as much as 70 g's.

One method of protecting such equipment is to encase it with shock absorbing material such as Styrofoam® "peanuts." However, such systems are messy, as the peanuts' light weight makes them prone to being scattered both during packing at the manufacturer's site as well as unpacking at the customer's site. Furthermore, Styrofoam® peanuts are not environmental friendly, since Styrofoam® is not biodegradable. Of even greater engineering significance is that peanuts are inconsistent in their protection against shock. That is, peanuts can shift about during transit, such that different areas within a shipping container are afforded unpredictably varying levels of impact protection.

Another method of protecting such equipment is to engineer a packing cushion, either from fabricated foam or molded material. Fabricated foam (such as polyurethane) is hand or die cut, and then assembled (typically using heat welding) to create a custom shaped protector. Fabricated foam is thus both labor intensive (in assembly steps) and materiel expensive (in the cost of component shapes and scrap material inherent in the assembly process). Molded material (such as polystyrene) is formed by a mold that is specific to the shape of the product being shipped. Molded materials are thus also both labor intensive (in creating and using the molds), equipment expensive (in the molding machines), and materiel expensive (cost of the molding material). Like the use of dunnage such as peanuts, fabricated foam and molded material are also environment unfriendly.

SUMMARY OF THE INVENTION

In response to the shortcomings of the prior art system described, the present invention is thus directed to a rollover shipping cushion. The cushion is formed by folding, in a specific manner, a single sheet of die-cut corrugated fiberboard to create the cushion. When properly folded, the cushion includes a central shipping cavity that is surrounded by shock-absorbing tubes on all six sides of the central shipping cavity.

The above, as well as additional purposes, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

FIGS. 1*b*-1*n* illustrate the single piece of corrugated fiberboard in various stages of being folded to form a rollover shipping cushion;

DETAILED DESCRIPTION OF THE PREFERRED EMBODIMENT

Figure 1A:
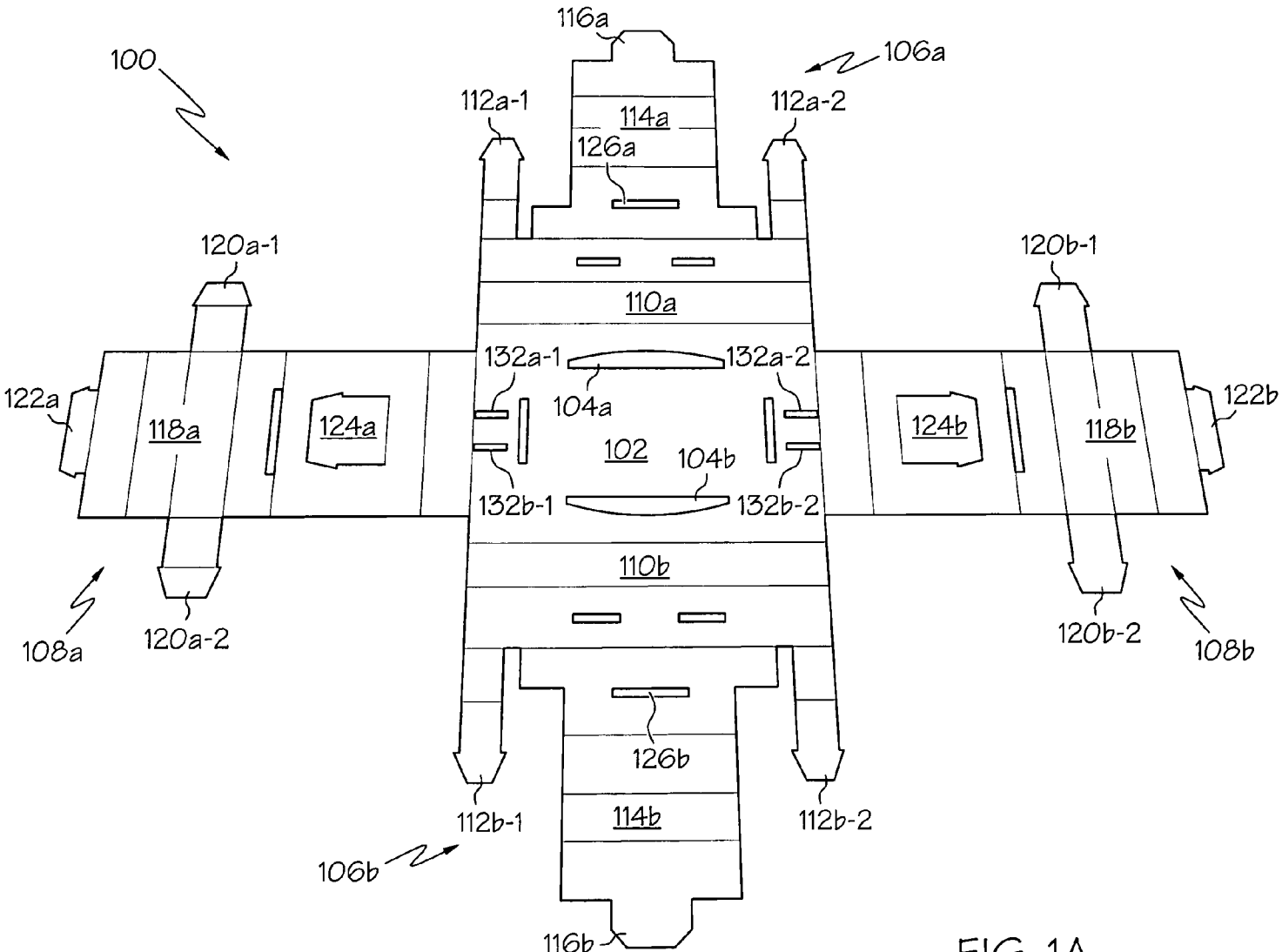
FIG. 1*a* depicts a single piece of corrugated fiberboard in an unfolded condition after having been die-cut to create the depicted shape and folding edges.

With reference now to the figures, and in particular to FIG. 1A, a drawing is presented of an unfolded corrugated cushion 100. Corrugated cushion 100 includes a central sheet 102, which includes a bottom tube slot 104. About central sheet 102 are side assemblies 106*a-b* and end assemblies 108*a-b*. Side assemblies 106*a-b* each have a respective side tube sheet 110*a-b*, side tube support tabs 112*a*(1,2)-*b*(1,2), bottom tube sheets 114*a-b*, and bottom tube locking tabs 116*a-b*. End assemblies 108*a-b* each have a respective top tube sheet 118*a-b*, top tube locking tabs 120*a*(1,2)-*b*(1,2), top tube end tabs 122*a-b*, and top lid sheets 124*a-b*. Adjacent the top lid sheets 124 are side tube support tab locking slots 132.

Figure 1B:
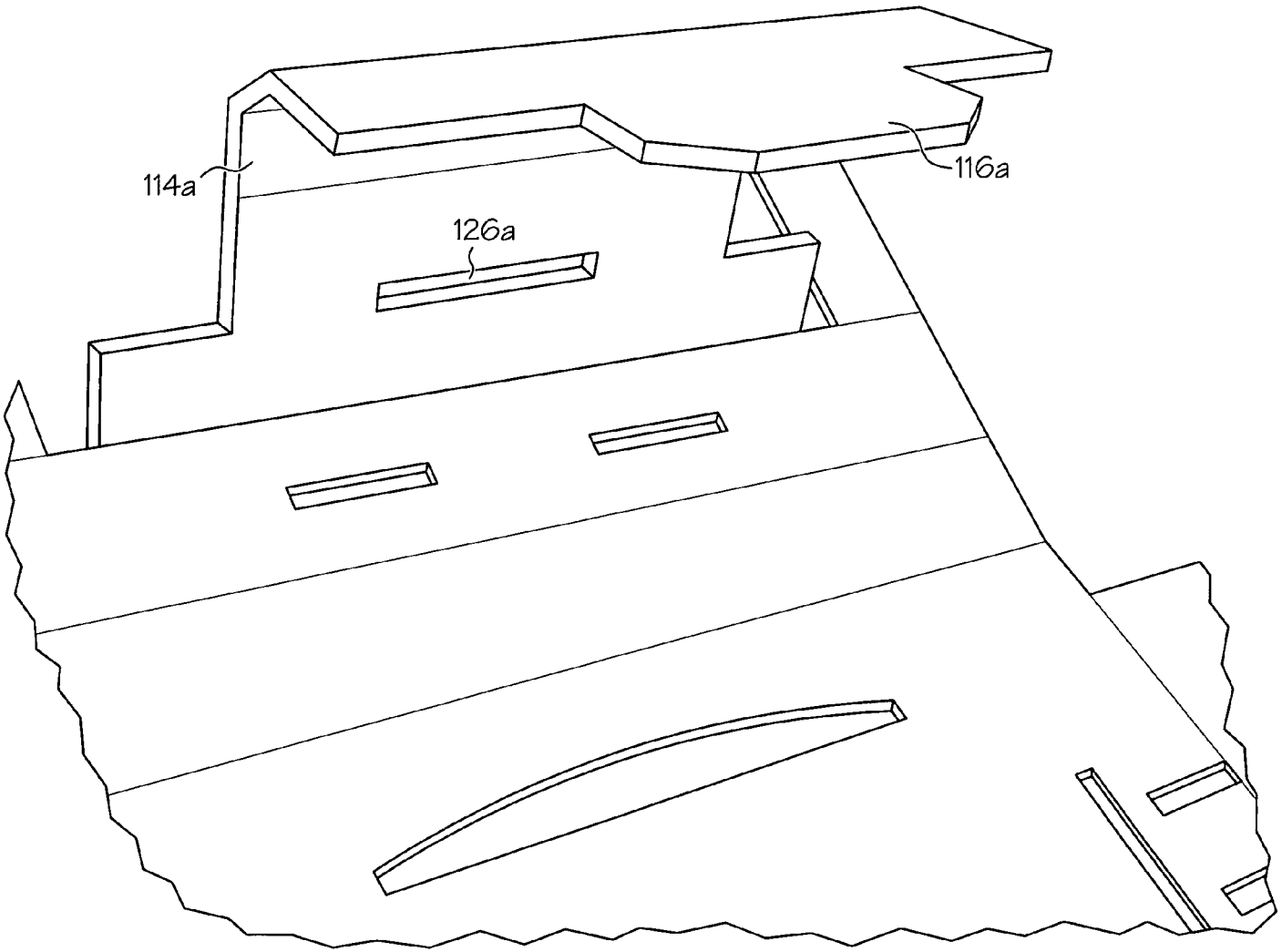
Figure 1C:
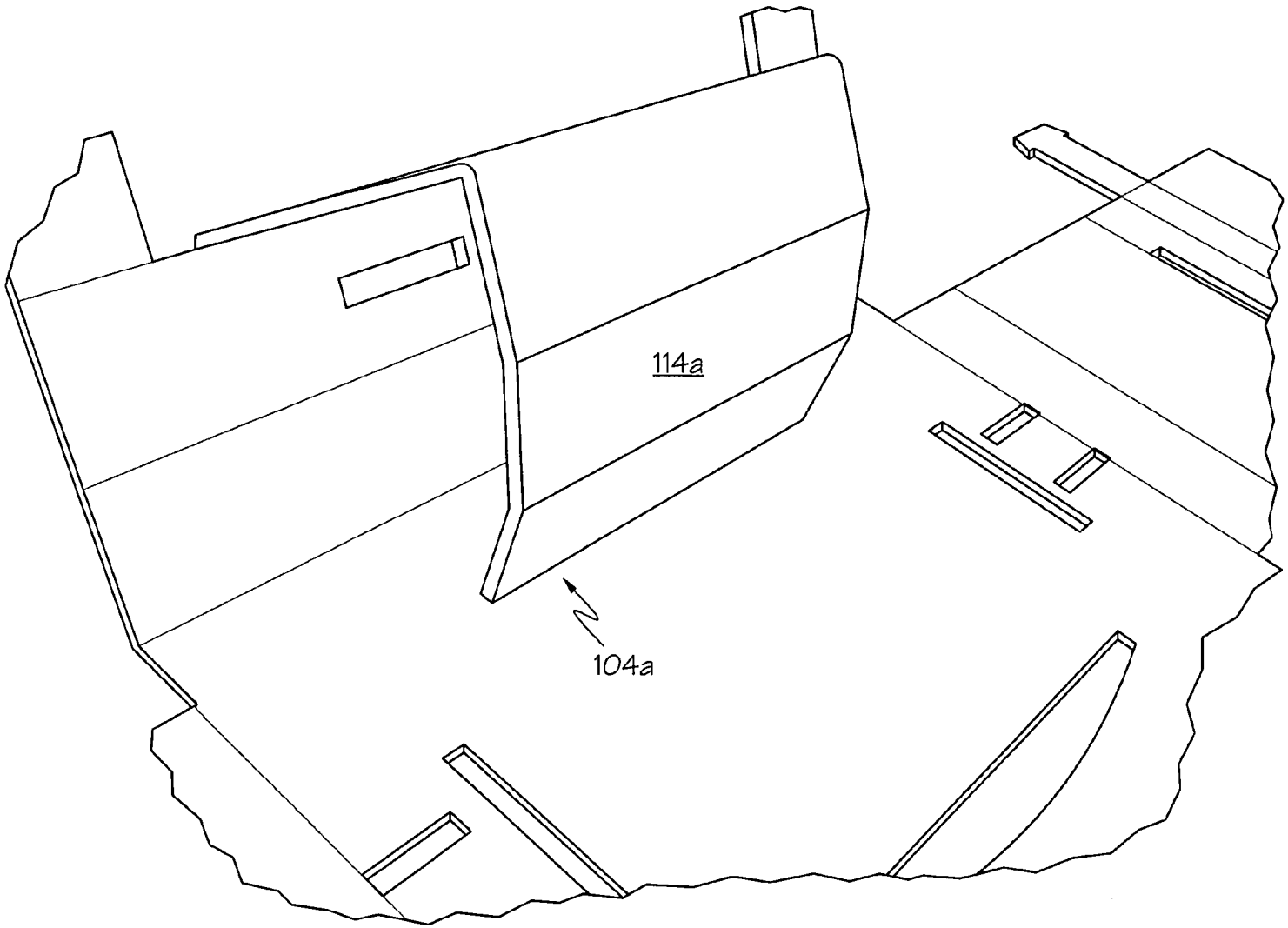
Figure 1D:
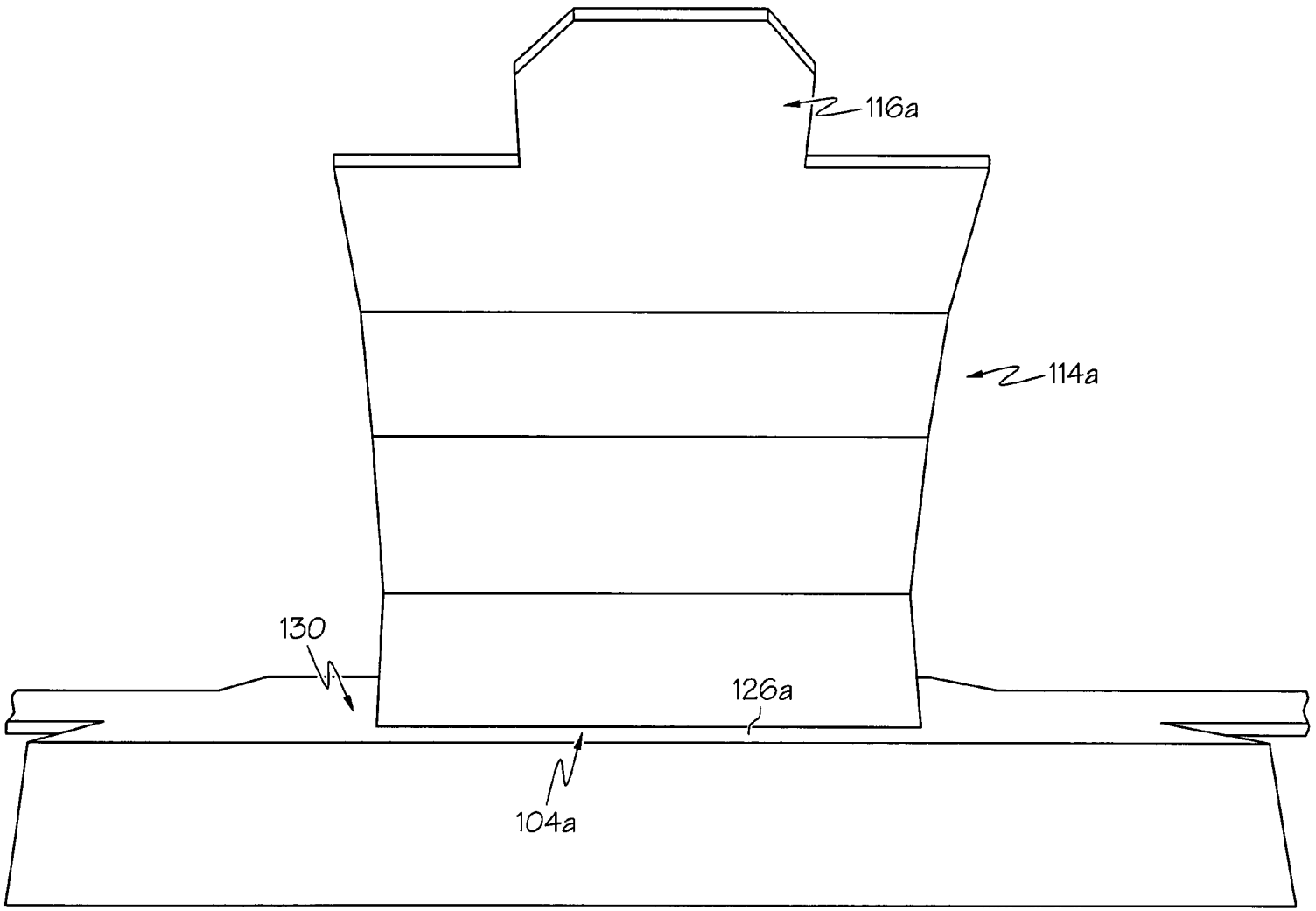
Figure 1E:
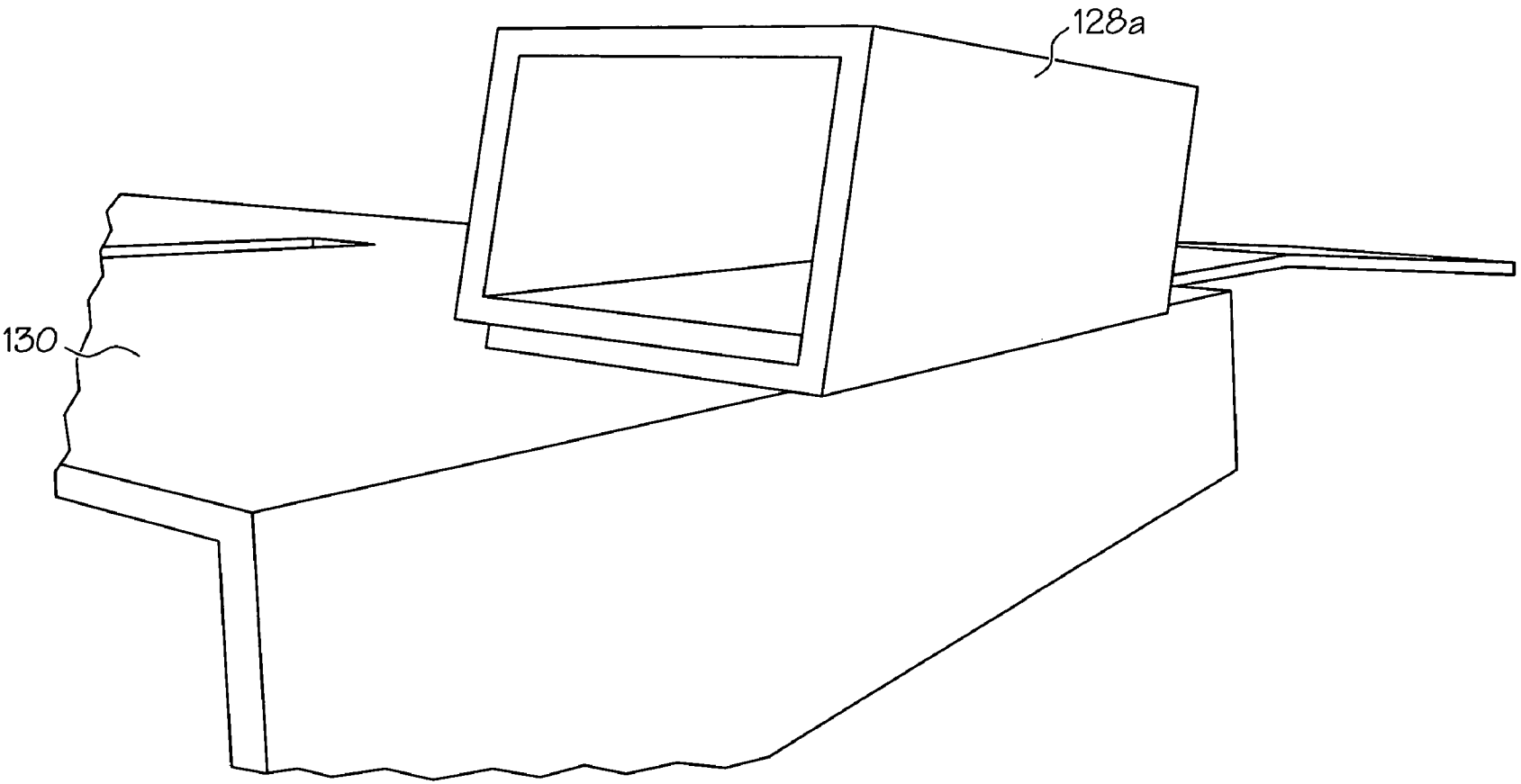

Representative steps taken to create an assembled rollover cushion 200 (shown in FIGS. 2A-B) are presented in FIGS. 1B-N. With reference then to FIG. 1B, bottom tube sheet 114*a* is folded upwards and then back downwards through bottom tube slot 104*a* (FIG. 1C) until bottom tube locking slot 126 is exposed below a cushion bottom 130 side of corrugated cushion 100 (FIG. 1D). Bottom tube sheet 114*a* is roll-folded until bottom tube locking tab 116*a* locks into bottom tube locking slot 126*a* to form an assembled bottom tube 128*a* (FIG. 1E).

Figure 1F:
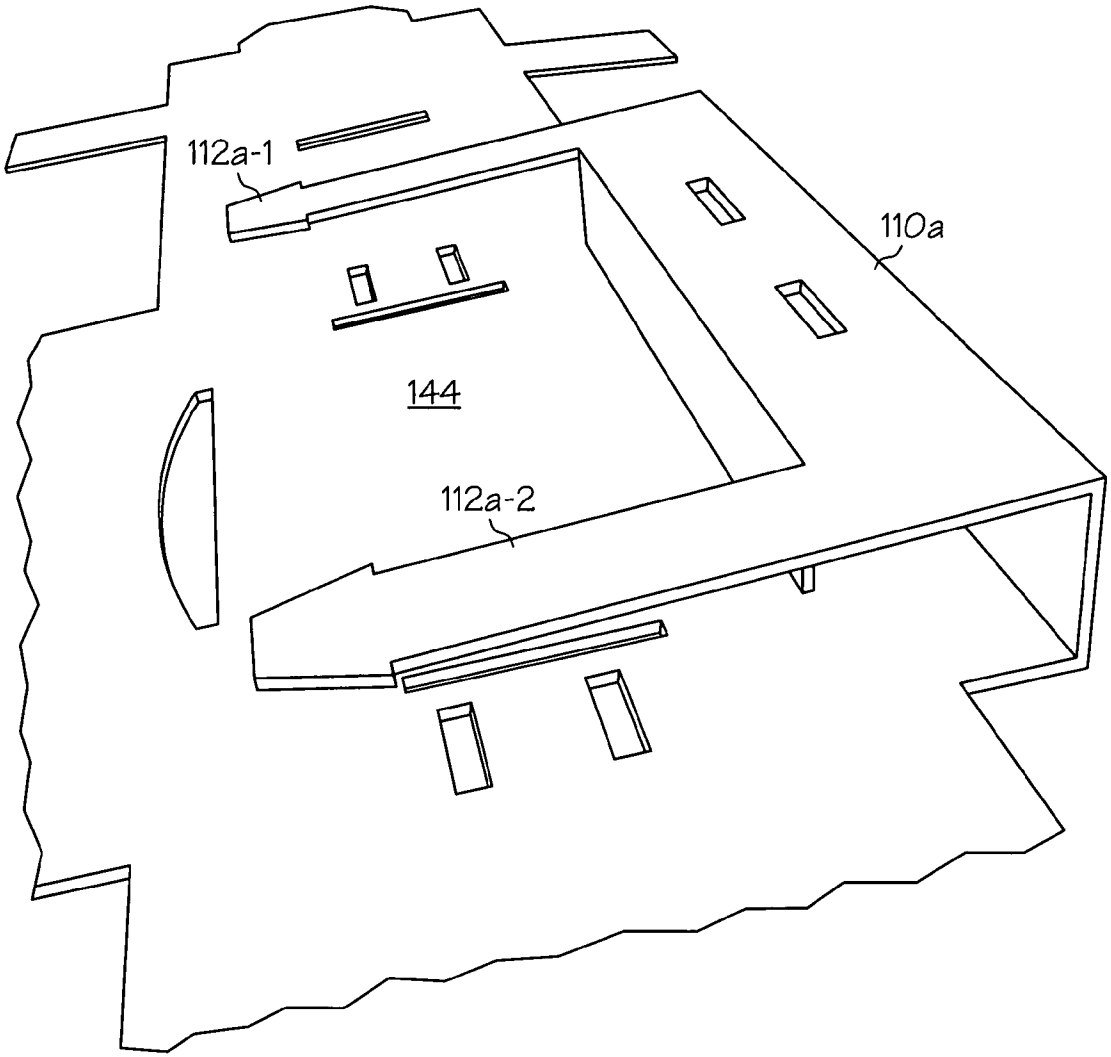
Figure 1G:
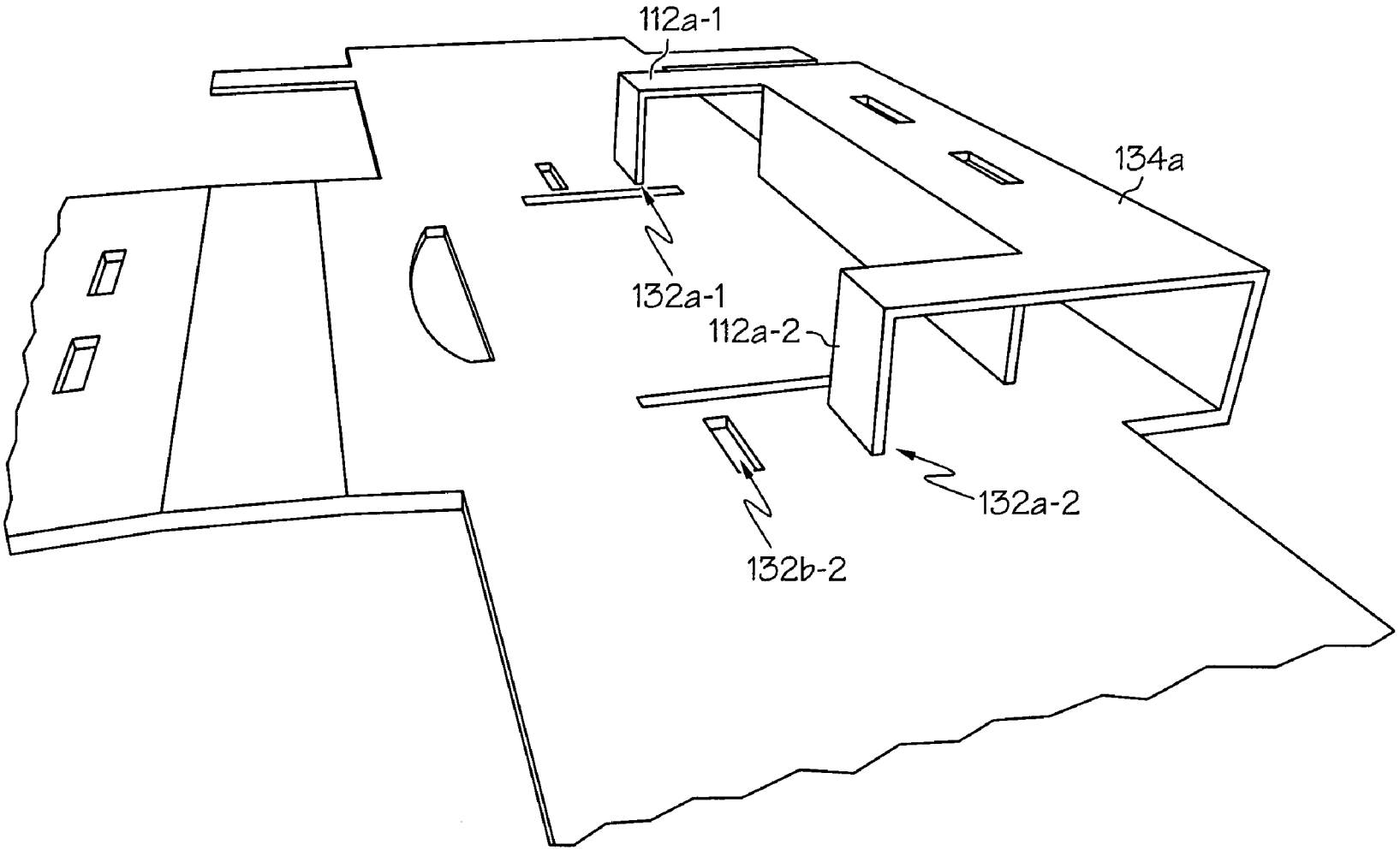
Figure 1H:
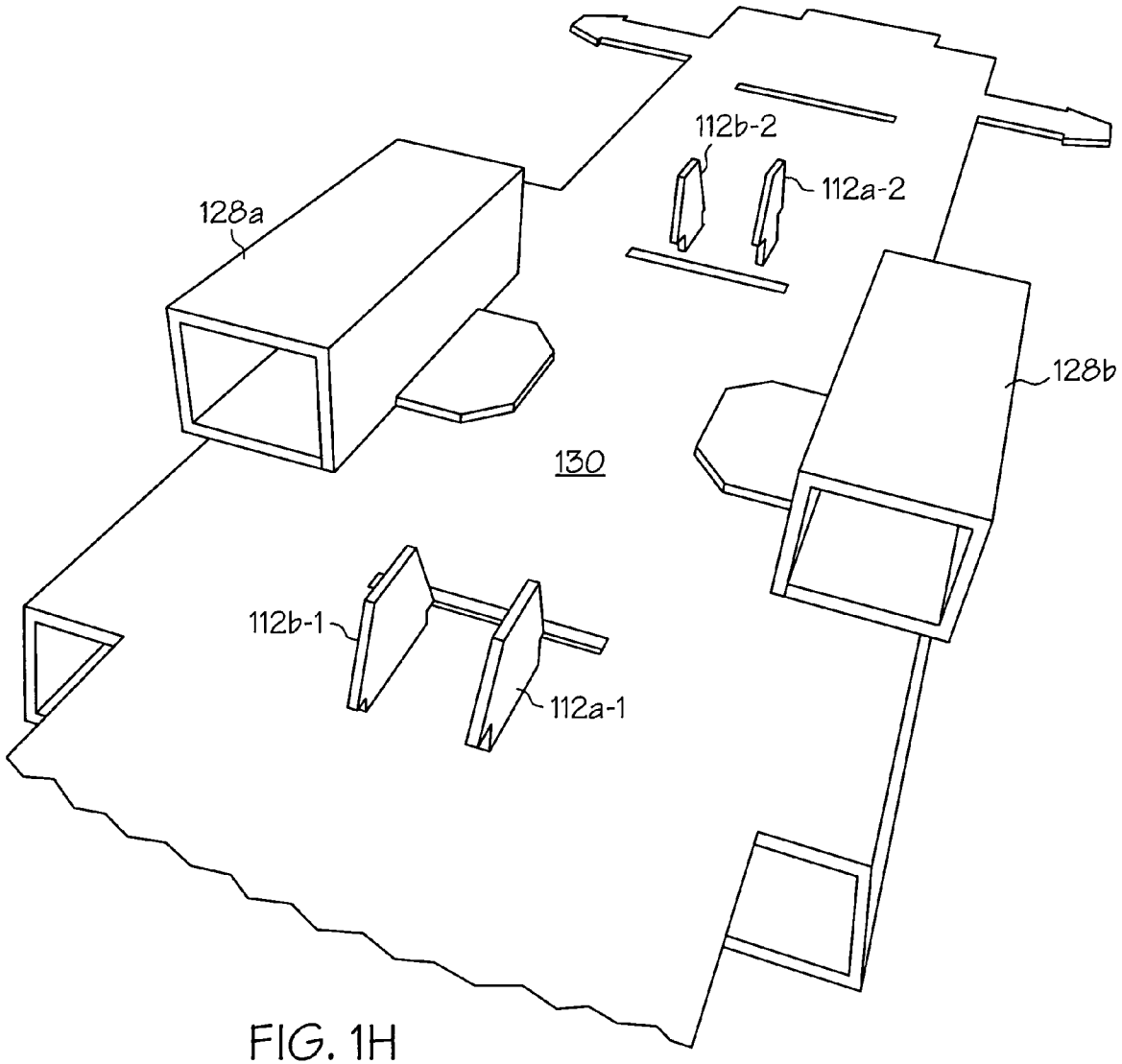
Figure 11:
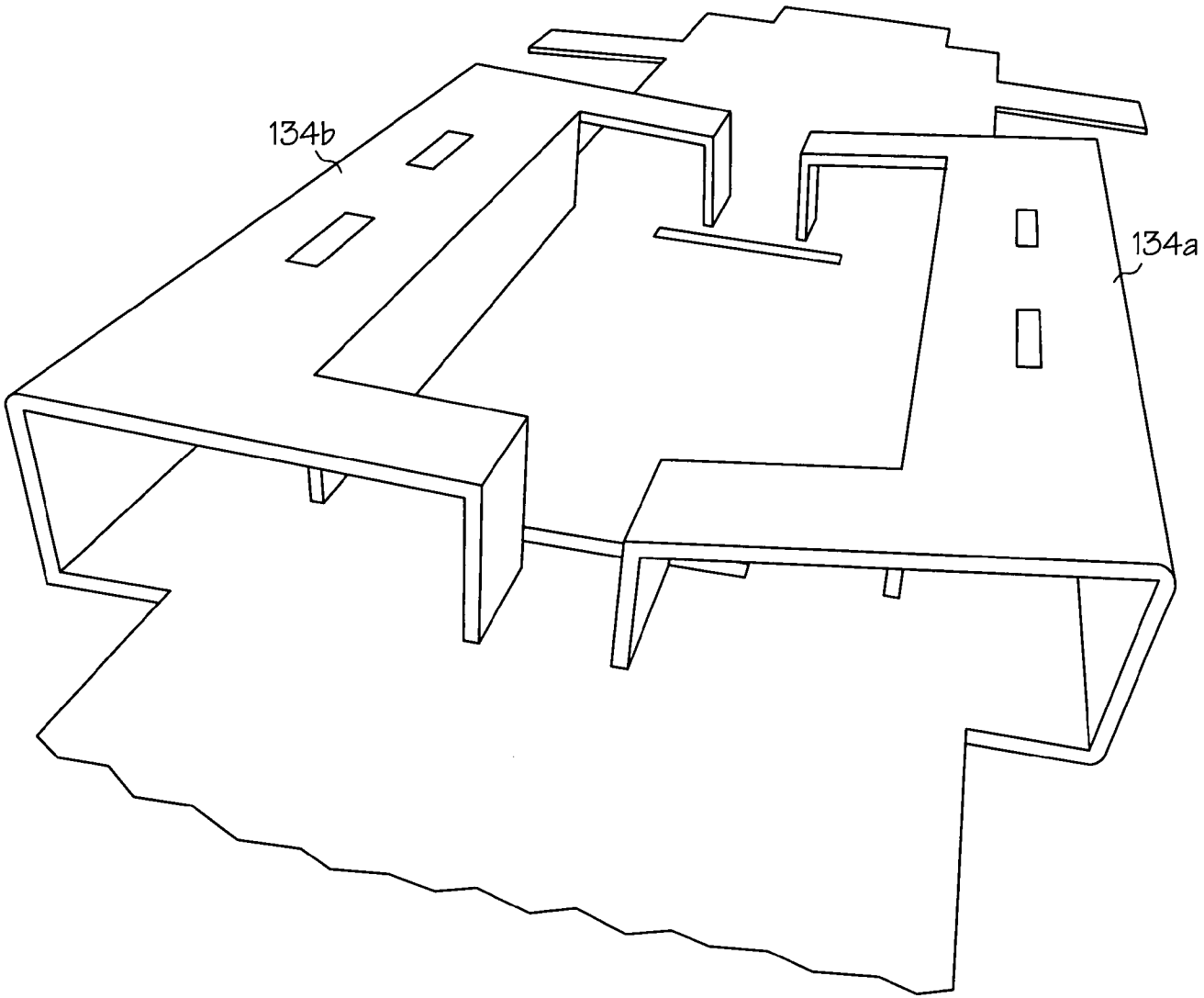

After bottom tube 128*a* is assembled, side tube sheet 110*a* has the shape shown in FIG. 1F on the top side 144 of unfolded corrugated cushion 100, in which side tube support tabs 112*a*-1,2 are extended as shown. Side tube support tabs 112*a*-1,2 are then folded downward as shown to lock into their respective side tube support tab locking slots 132*a*-1,2 to finish the formation of an assembled side tube 134*a* (FIG. 1G).

Figure 1J:
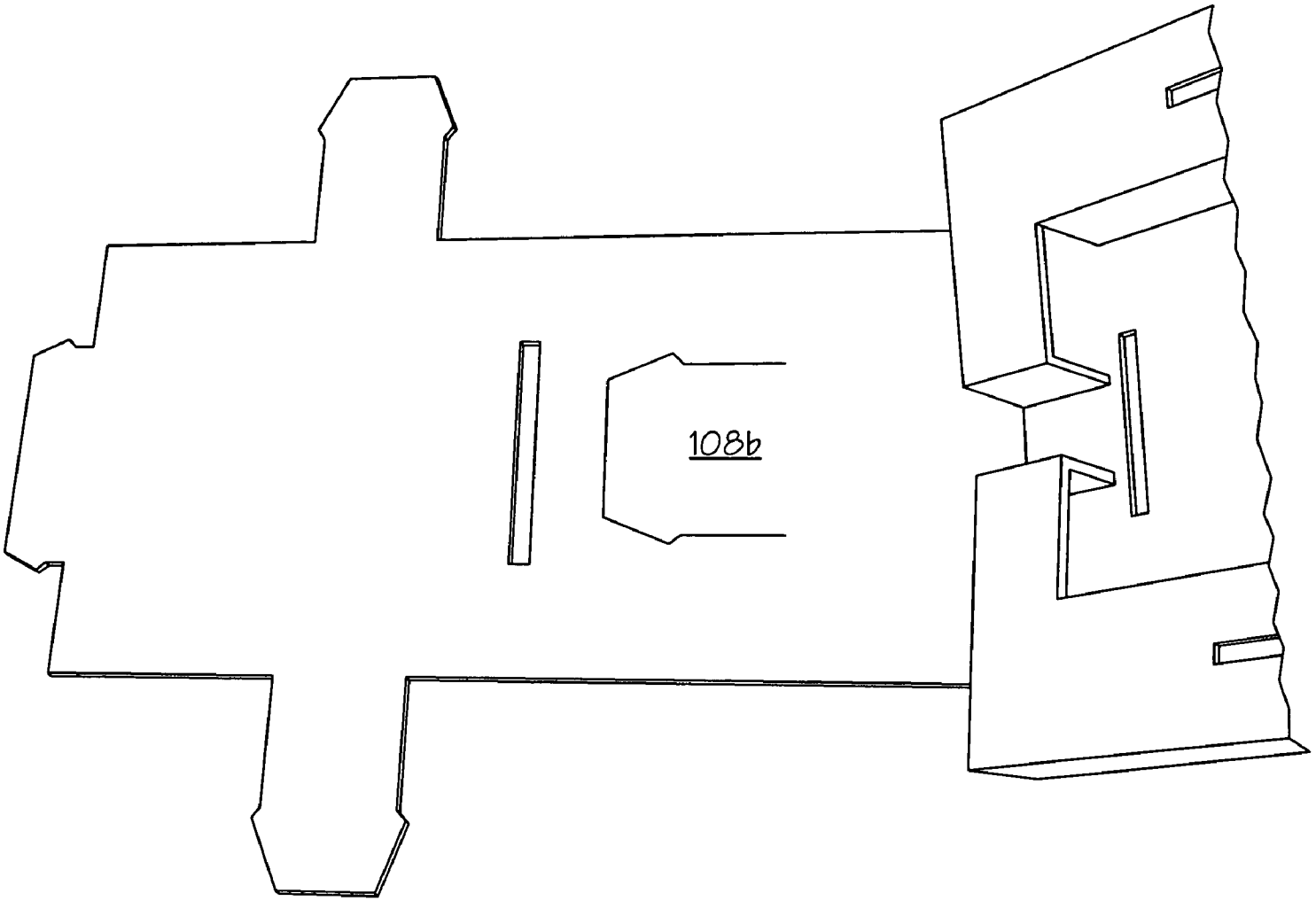
Figure 1K:
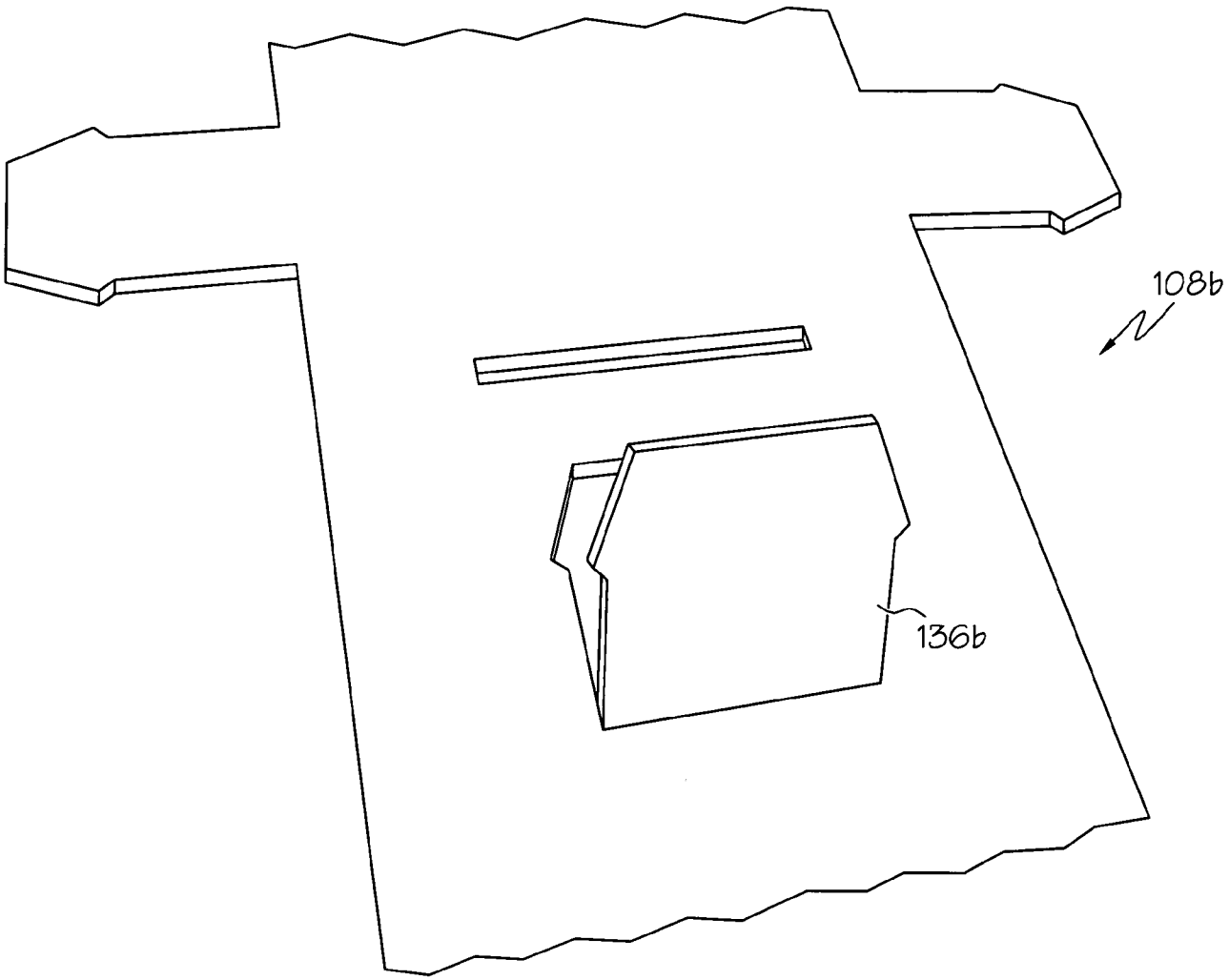
Figure 1L:
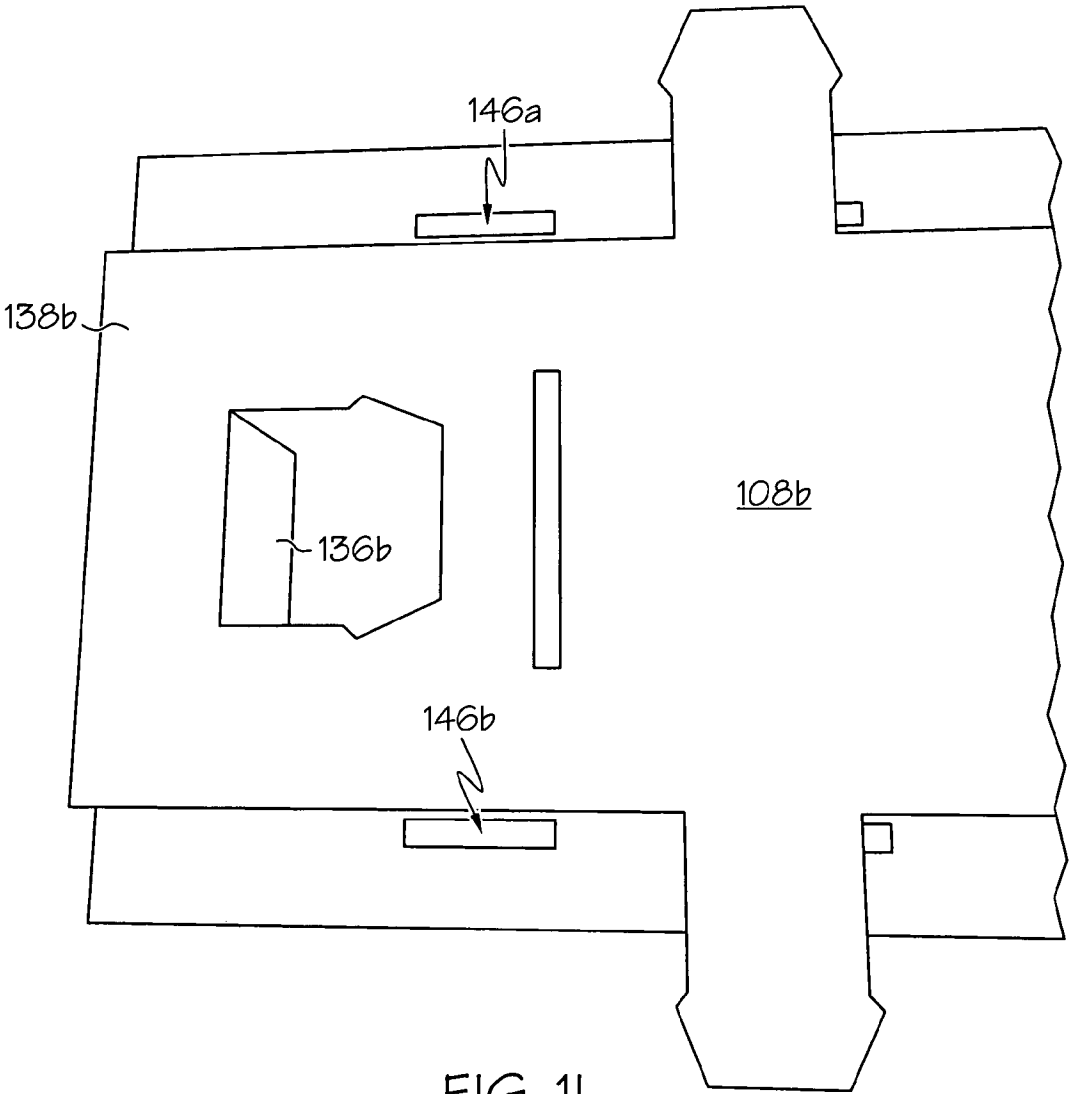
Figure 1M:
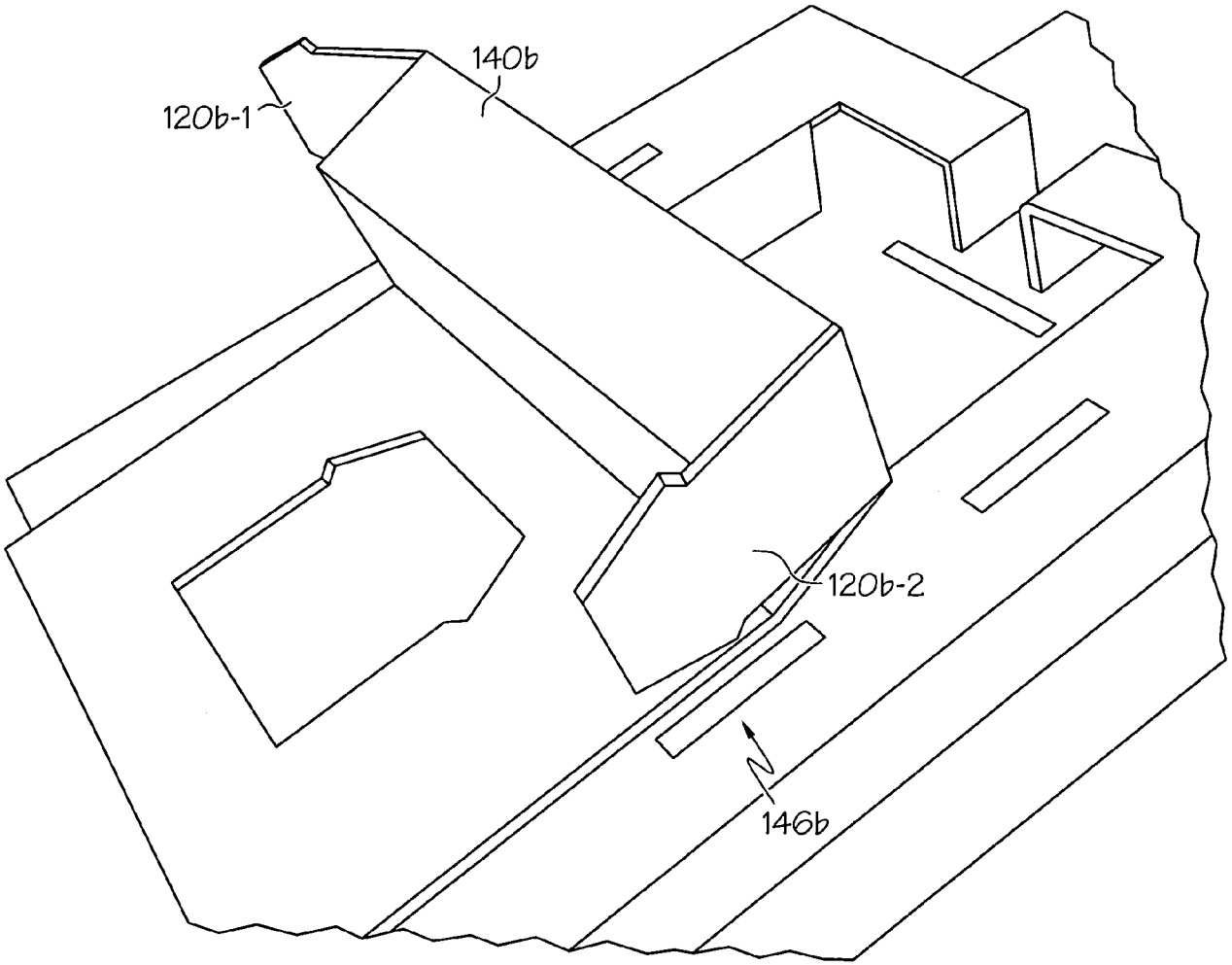
Figure 1N:
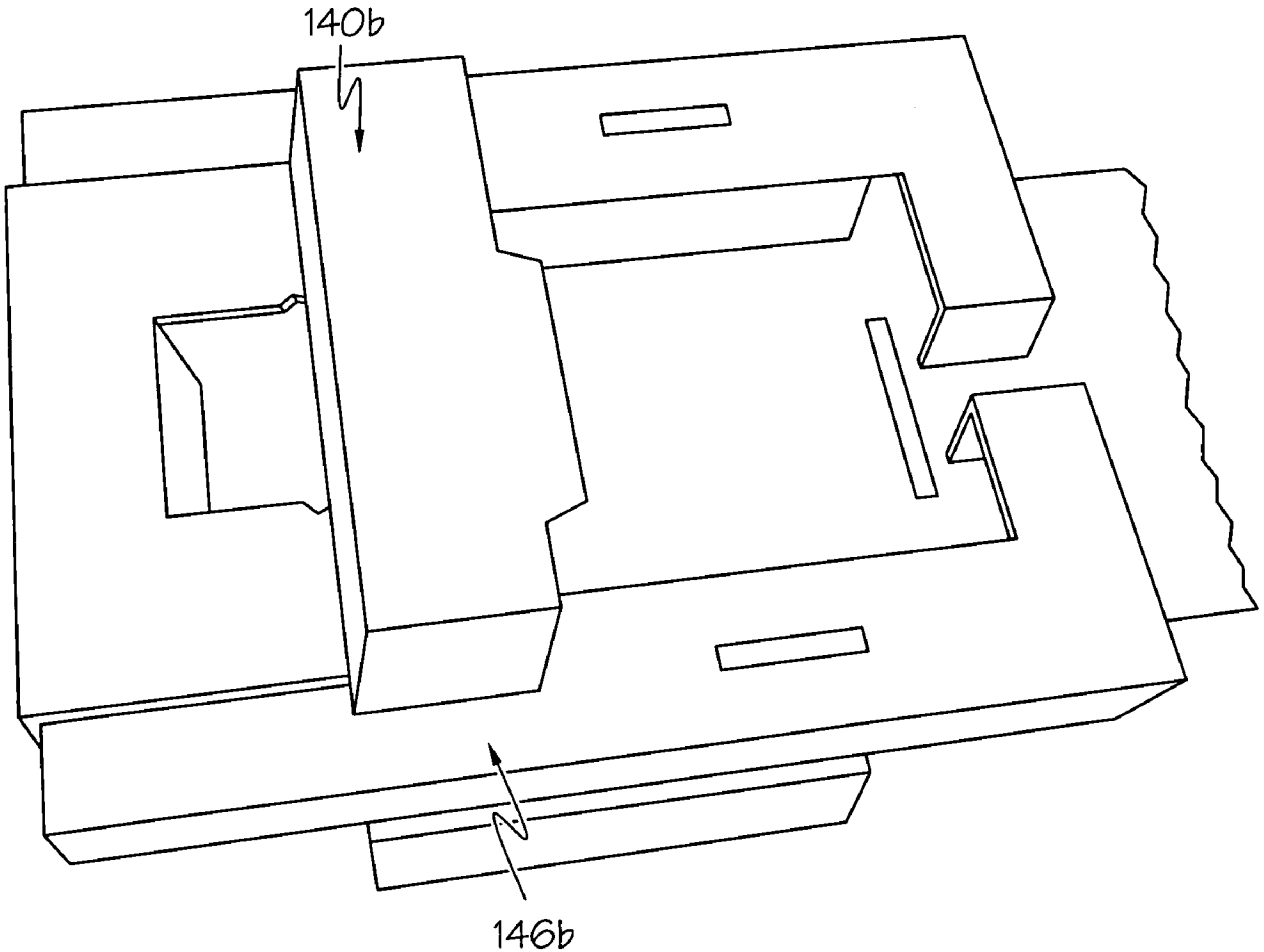

The folding process just described is repeated for bottom tube sheet 114*b* to create assembled bottom tube 128*a* (shown in FIG. 1H along with protruding side tube support tabs 112*a*-1,2 and 112*b*-1,2), and assembled side tube 134*b* shown in FIG. 1I With reference now to FIG. 1J, end assembly 108*b* is then folded upwards. An end tube locking tab 136*b* is punched out from end assembly 108*b* (FIG. 1K). End assembly 108*b* is laid down and end tube locking tab 136*b* is folded down to complete the formation of an end tube 138*b* (FIG. 1L). End assembly 108*b* is rolled up to form a top tube 140*b*, which includes top tube locking tabs 120*b*-1,2 (FIG. 1M), which is locked down into top tube locking slots 146*a-b*.

Figure 2A:
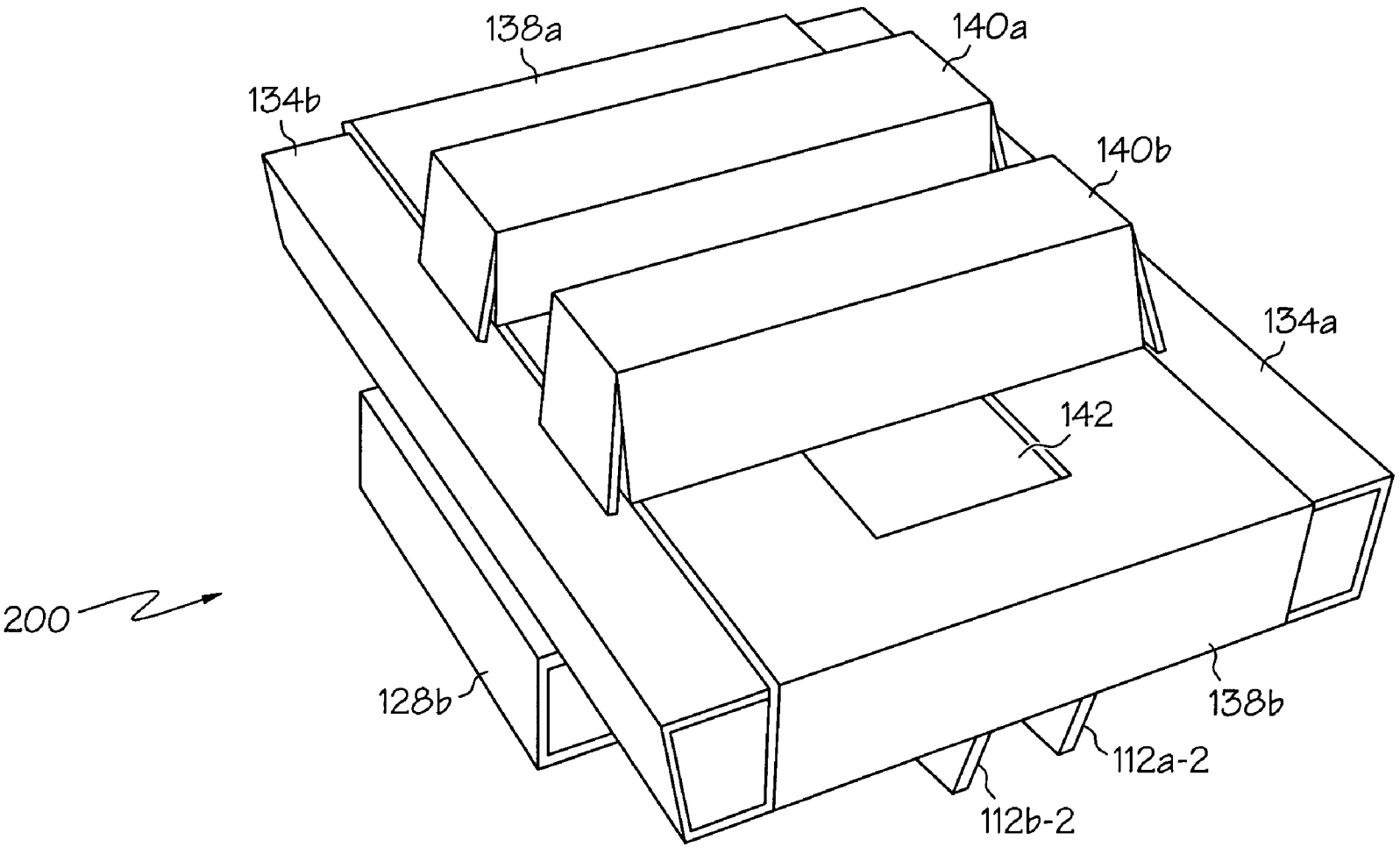
FIG. 2*a* depicts a top view of the completed rollover shipping cushion.
Figure 2B:
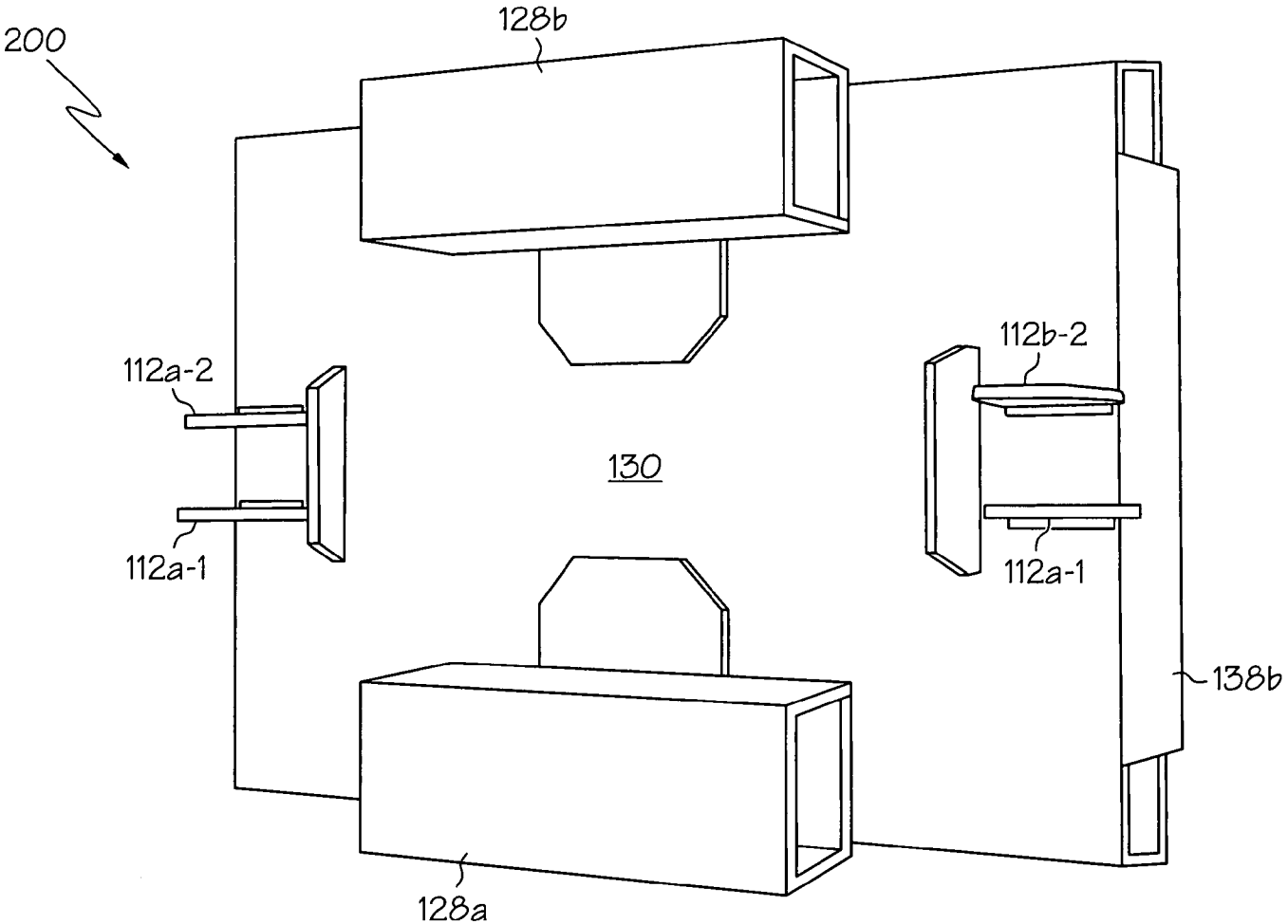
FIG. 2*b* illustrates a bottom view of the completed rollover shipping cushion.

The steps just described are repeated using end assembly 108*a* to form top tube 140*a* shown in FIG. 2*a*. As show in the top view of assembled rollover cushion 200 in FIG. 2*a*, rollover cushion 200 has top tubes 140*a-b* on top, side tube 134*a* on one side and side tube 134*b* on another side, end tube 138*a* on one end and end tube 138*b* on an opposing end. As seen in the bottom view of assembled rollover cushion 200 in FIG. 2*b,* rollover cushion 200 has two bottom tubes 128*a-b* on the cushion bottom 300, as well as side tube support tabs 112*a,b*-1,2 that provide additional shock protection.

With reference again to FIG. 2*a,* shipping cavity 142 provides a cushioned and centrally positioned space in which physical-shock-sensitive items can be placed for shipment. The assembled rollover cushion 200, with the physical-shock-sensitive item within shipping cavity 142, is then placed snugly inside another external shipping box (not shown). If and when the external shipping box is struck, the assembled rollover cushion 200 provides cushioning that flattens out (decreases amplitude while extending the length of) a shock wave caused by the external shipping box being struck. Thus, the shipped item is in a semi-suspended position that is protected from such physical-shock waves.

In a preferred embodiment, the described rollover cushion 200 (and its precursor unfolded corrugated cushion 100) is made of a corrugated material, such as fiberboard, cardboard, pulp board, corrugated plastic, etc., which is easily foldable and die-cut. Since rollover cushion 200 is created from a single stock item (unfolded corrugated cushion 100), inventory of packing materials is simplified and made cheaper. Likewise, when unpacking a shipped item, rollover cushion 200 is a single piece that is easy to discard or unfold for future use.

As depicted in the drawings and attendant descriptions, in a preferred embodiment the present invention thus provides a rollover cushion that includes a shipping cavity, two top tubes, two bottom tubes, first and second side tubes and first and second end cushions that are formed when a single piece of material is folded in a prescribed manner. When the single piece of material is folded in the prescribed manner, the shipping cavity has dimensions such that an item being contained within the rollover cushion is abutted against a first side of a planar element on every side of the item being contained. Furthermore, when folded, the rollover cushion is such that every planar element has a folded cushion on a second side of each planar element, such that the combined folded cushions provide physical shock protection in all three axes.

While the invention has been particularly shown and described with reference to a preferred embodiment, it will be understood by those skilled in the art that various changes in form and detail may be made therein without departing from the spirit and scope of the invention.

What is claimed is:

1. A rollover shipping cushion comprising:

a single piece of foldable material composed of:

a central sheet;

a first end assembly and a second end assembly attached to the central sheet, wherein each end assembly includes:

a top tube sheet composed of:

a first tab and a second side extending away from a first side and a second side of the top tube sheet, and an end tab extending away from an end of the top tube sheet; and a top lid sheet;

a first side assembly and a second side assembly attached to the central sheet, wherein each side assembly includes:

a bottom tube sheet having a bottom tube locking tab, wherein the bottom tube sheet has a width that is narrow enough to slide through a bottom tube slot in the central sheet, and a side tube sheet having a first support tab and a second support tab;

wherein, when folded, the single piece of foldable material forms a rollover shipping cushion that includes:

a first top tube and a second top tube formed from top tube sheets of the first and second end assemblies, a first bottom tube and a second bottom tube formed from bottom tube sheets of the first and second side assemblies, a first side tube and a second side tube formed from side tube sheets of the first side assembly and the second side assembly, a first end cushion and a second end cushion formed by top lid sheets of the first end assembly and the second end assembly folding around ends of the first and second side tubes, and a central shipping cavity formed by:

the central sheet, the first and second side tubes, and the top lid sheets wrapping across ends of the first and second side tubes.

2. The rollover shipping cushion of claim 1, wherein the cushion is made of corrugated fiberboard.

3. The rollover shipping cushion of claim 2, wherein the rollover shipping cushion is sized to fit snugly within a shipping box, and wherein the rollover shipping cushion provides a space cushion between an item within the shipping cavity and all corners of the shipping box.

* * * * *